United States Patent [19]

Maglica

[11] Patent Number: 4,864,474

[45] Date of Patent: Sep. 5, 1989

[54] SINGLE CELL FLASHLIGHT

[75] Inventor: Anthony Maglica, Ontario, Calif.

[73] Assignee: MAG Instrument, Inc., Ontario, Calif.

[21] Appl. No.: 187,827

[22] Filed: Apr. 29, 1988

Related U.S. Application Data

[63] Continuation-in-part of Ser. No. 34,918, Apr. 6, 1987, abandoned, which is a continuation of Ser. No. 828,729, Feb. 11, 1986, Pat. No. 4,658,336, which is a continuation of Ser. No. 648,032, Sep. 6, 1984, Pat. No. 4,577,263.

[51] Int. Cl.[4] ..... F21L 7/00

[52] U.S. Cl. ..... 362/203; 362/116; 362/187; 362/205; 362/207

[58] Field of Search ..... 362/116, 158, 187, 188, 362/202, 203, 204, 205, 207, 109

[56] References Cited

U.S. PATENT DOCUMENTS

| | | | |
|---|---|---|---|
| 2,490,830 | 12/1949 | Norton | 362/205 |
| 2,737,574 | 3/1956 | Muller | 362/116 |
| 4,472,766 | 9/1984 | Hung | 362/205 X |
| 4,495,511 | 1/1985 | Foltz | 362/205 |
| 4,504,890 | 3/1985 | Chan | 362/205 X |
| 4,531,178 | 7/1985 | Uke | 362/205 X |
| 4,581,686 | 4/1986 | Nelson | 362/204 |
| 4,658,336 | 4/1987 | Maglica | 362/205 X |
| 4,725,932 | 2/1988 | Gammache | 362/188 X |

OTHER PUBLICATIONS

Weston, "Mini Flash Lite", advertisement received in U.S. Patent & Trademark Office, Jul. 11, 1949.

Brinkmann, Micro-Max 1 Package Insert, Copyright 1987, (Photocopies of Flashlight Included in Package and Pictures of Disassembled Flashlight Enclosed).

*Primary Examiner*—Stephen F. Husar

*Attorney, Agent, or Firm*—Lyon & Lyon

[57] ABSTRACT

A single cell flashlight which comprises a barrel, a tailcap, a head assembly, and a semi-permanently mounted reflector, lens and o-ring within the head assembly; which may be switched on and off by rotation of the head assembly with respect to the barrel; which may be focused upon further rotation of the head assembly with respect to the barrel; which may be used as a source of unfocused, substantially spherical illumination by removal of the head assembly from the barrel; which may be provided with a lanyard or a key ring holder positioned near the head end of the flashlight to provide for simultaneous illumination of a lock as well as its key with one-hand operation of the flashlight; and which is provided with a special tailcap insert for that a single-cell flashlight employing batteries of a "AAA", "AAAA" or special size batteries.

14 Claims, 5 Drawing Sheets

36
21
31
49
24
48
41
33
38
39
A
A
42
46
47
53
52
25
53A
25'
26
51
51'
45
26'

28
22
33
74
73
62
32
34
95
21
31
97
20
49
23
24
48
38
39
41
42
46
47
53
43
44
52
25
53A
51
45
26

2
28
22
29
20
27
21
24
25
23
2
26

SINGLE CELL FLASHLIGHT

This is a continuation-in-part of application Ser. No. 034,918, filed Apr. 6, 1987, now abandoned, which is a continuation of application Ser. No. 828,729, filed Feb. 11, 1986, now U.S. Pat. No. 4,658,336, which is a continuation of application Ser. No. 648,032, filed Sept. 6, 1984, now U.S. Pat. No. 4,577,263.

BACKGROUND OF THE INVENTION

1. Field Of The Invention

The present invention relates primarily to flashlights, and in particular, to a miniature, single cell, hand held flashlight.

2. Discussion Of The Prior Art

Flashlights of varying sizes and shapes are well known in the art. In particular, certain of such known flashlight utilize one or more dry cell batteries, carried in a cylindrical tube serving as a handle for the flashlight, as their source of electrical energy. Typically, an electrical circuit is established from one electrode of the battery through a conductor to a switch, then through a conductor to one electrode of the lamp bulb. After passing through the filament of the lamp bulb, the electrical circuit emerges through a second electrode of the lamp bulb in electrical contact with a conductor, which in turn is in electrical contact with the flashlight housing. The flashlight housing provides an electrical conduction path to an electrical conductor, generally a spring element, in contact with the other electrode of the battery. Actuation of the switch to complete the electrical circuit enables electrical current to pass through the filament, thereby generating light which is typically focused by a reflector to form a beam of light.

The production of light from such flashlights has often been degraded by the quality of the reflector and lamp utilized, the optical characteristics of any lens interposed in the beam path, and problems associated with contamination in, on or damage to the lamp, lens and reflector.

SUMMARY OF THE INVENTION

It is a primary object of the present invention to provide a miniature, single cell, hand-held flashlight having improved optical characteristics.

It is another object of the present invention to provide a miniature, single cell, hand-held flashlight which is capable of producing a beam of light having a variable dispersion.

It is a further object of the present invention to provide a miniature, single cell hand-held flashlight which is capable of serving as a substantially spherical unfocused light source upon removal of the head assembly.

It is another object of the present invention to provide a miniature, single cell, hand-held flashlight wherein relative motion of components that produce the variation and the dispersion of the light beam provide an electrical switch function to open and complete the electrical circuit of the flashlight.

It is another object of the present invention to provide a miniature, single cell, hand-held flashlight with a key holder sized and positioned such that the light from the flashlight simultaneously may be focused on the lock and its key or other small tool during locking and unlocking operation with the flashlight and key being held in one hand.

These and other objects of the present invention, which may become obvious to those skilled in the art through the hereinafter detailed description of the invention are achieved by a miniature flashlight comprising: a cylindrical tube containing one miniature battery, a lamp bulb holder assembly including at least one insulator and electrical conductors for making electrical contact between terminals of a miniature lamp held therein and the cylindrical tube and an electrode of the battery, respectively, retained in one end of the cylindrical tube adjacent the battery, a tailcap and spring member enclosing the other end of the cylindrical tube and providing an electrical contact to the other electrode of the battery, and a head assembly including a head, a reflector, a lens, and an o-ring, which head assembly is rotatably mounted to the cylindrical tube such that the lamp bulb extends through a hole in the center of the reflector within the lens. In the principle embodiment of the present invention, the battery is of the size commonly referred to as a AAA size battery. The single cell flashlight of the present invention may also use an AAAA, AA or a special size battery.

The head assembly engages threads formed on the exterior of the cylindrical tube such that rotation of a head assembly about the axis of the cylindrical tube will change the relative displacement between the lens and the lamp bulb. When the head assembly is fully rotated onto the cylindrical tube, the reflector pushes against the forward end of the lamp holder assembly causing it to shift rearward within the cylindrical tube against the urging of the spring contact at the tailcap. In this position, the electrical conductor within the lamp holder assembly which completes the electrical circuit from the lamp bulb to the cylindrical tube is not in contact with the tube. Upon rotation of the head assembly in a direction causing the head assembly to move forward with respect to the cylindrical tube, pressure on the forward surface of the lamp holder assembly from the reflector is relaxed enabling the spring contact in the tailcap to urge the batteries and the lamp holder assembly in a forward direction, which brings the electrical conductor into contact with the cylindrical tube, thereby completing the electrical circuit and causing the lamp bulb to illuminate. At this point, the lamp holder assembly engages a stop which prevents further forward motion of the lamp holder assembly with respect to the cylindrical tube. Continued rotation of the head assembly in a direction causing the head assembly to move forward relative to the cylindrical tube causes the reflector to move forward relative to the lamp bulb, thereby changing the focus of the reflector with respect to the lamp bulb, which results in varying the dispersion of the light beam admitted through the lens.

By rotating the head assembly until it disengages from the cylindrical tube, the single cell flashlight of the present invention becomes a source of substantially spherical illumination. With the flashlight operated in this mode it provides an unfocused source of light similar to that of a candle. Also, in this mode the single cell flashlight may be stood upright with its tailcap end resting on a horizontal surface.

The single cell flashlight of the present invention may also be provided with a key ring holder at its head or a lanyard to be attached at its tailcap end to provide attachment of keys to the flashlight in such a manner that the light from the flashlight may be simultaneously directed not only at a lock, but also at the key which is to be used for operation of the lock and which is held in the same hand that is holding the flashlight.

DETAILED DESCRIPTION OF A PREFERRED EMBODIMENT

Figure 1:
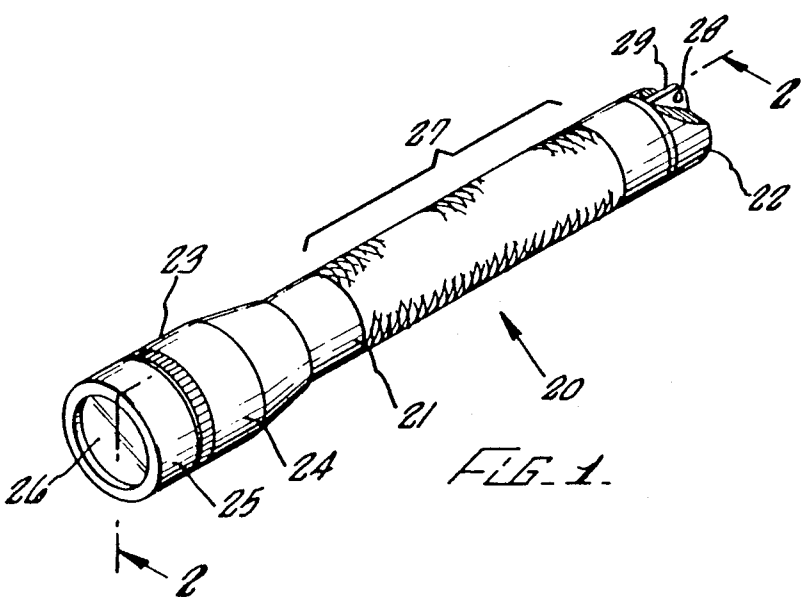
FIG. 1 is a perspective view of a flashlight which incorporates the switching and focusing features of the present single cell flashlight invention.

Referring first to FIG. 1, a miniature flashlight incorporating the switching and focussing functions in accordance with the present invention is illustrated in perspective generally at 20. The miniature flashlight 20 is comprised of a generally right circular cylinder, or barrel 21, enclosed at a first end by a tailcap 22 and having a head assembly 23 enclosing a second end thereof. The head assembly comprises a head 25 to which is affixed a face cap 25 which retains a lens 26. The head assembly 23 has a diameter greater than that of the barrel 21 and is adapted to pass externally over the exterior of the barrel 21. The barrel 21 may provide a machined handle surface 27 along its axial extent. The tailcap 22 may be configured to include provision for attaching a handling lanyard through a hole 28 in a tab 29 formed therein.

Figure 2:
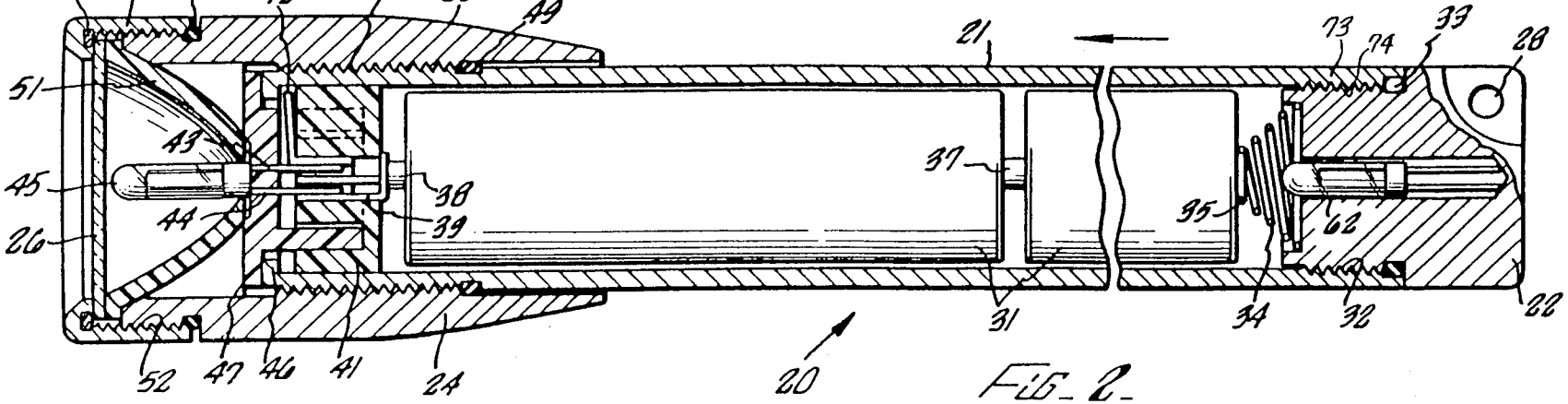
FIG. 2 is a partially foreshortened cross-sectional view of the miniature flashlight of FIG. 1 as taken through the plane indicated by 2—2.

Referring next to FIG. 2, the barrel 21 is seen to have an extent sufficient to enclose at least two miniature batteries 31 disposed in a series arrangement, although it may also be of a length to enclose only one battery. The tailcap 22 has a region of external threading 32 which engages matching threads formed on the interior surface of the barrel 21. A sealing element 33, typically in the form of an O-ring, is provided at the interface between the tailcap 22 and the barrel 21 to provide a watertight seal. A spring member 34 is disposed within the barrel 21 so as to make electrical contact with the tailcap 22 and a case electrode 35 of an adjacent battery 31. The spring member 34 also urges the batteries 31 in a direction indicated by an arrow 36. A center electrode 37 of the rearmost battery 31 is in contact with the case electrode of the forward battery 31. The center electrode 38 of the forward battery is urged into contact with a first conductor 39 mounted within a lower insulator receptacle 41. The lower insulator receptacle 41 also has affixed therein a side contact conductor 42. Both the center conductor 39 and the side contact conductor 42 pass through holes formed in the lower insulator receptacle in an axial direction, and both are adapted to frictionally receive and retain the terminal electrodes 43 and 44 of a miniature bi-pin lamp bulb 45. Absent further assembly, the lower insulator receptacle is urged in the direction indicated by the arrow 36, by the action of the spring 34, to move until it comes into contact with a lip 46 formed on the end of the barrel 21. At that point electrical contact is made between the side contact conductor 42 and the lip 46 of the barrel 21.

An upper insulator receptacle 47 is disposed external to the end of the barrel 21 whereat the lower insulator receptacle 41 is installed. The upper insulator receptacle 47 has extensions that are configured to mate with the lower insulator receptacle 41 to maintain an appropriate spacing between opposing surfaces of the upper insulator receptacle 47 and the lower insulator receptacle 41. The lamp electrodes 43 and 44 of the lamp bulb 45 pass through the upper insulator receptacle 47 and into electrical contact with the center conductor 39 and the side contact conductor 42, respectively, while the casing of the lamp bulb 45 rests against an outer surface of the upper insulator receptacle 47.

The head assembly 23 is installed external to the barrel 21 by engaging threads 48 formed on an interior surface of the head 24 engaging with matching threads formed on the exterior surface of the barrel 21. A sealing O-ring 49 is installed around the circumference of the barrel 21 adjacent the threads to provide a watertight seal between the head assembly 23 and the barrel 21. A substantially parabolic reflector 51 is configured to be disposed within the outermost end of the head 24, whereat it is rigidly held in place by the lens 26 which is in turn retained by the face cap 25 which is threadably engaged with threads 52 formed on the forward portion of the outer diameter of the head 24. O-rings 53 and 53A may be incorporated at the interface between the face cap 25 and the head 24 and the face cap 25 and the lens 26 to provide a water-tight seal.

When the head 24 is fully screwed onto the barrel 21 by means of the threads 48, the central portion of the reflector 51 surrounding a hole formed therein for passage of the lamp bulb 45, is forced against the outermost surface of the upper insulator receptacle 47, urging it in a direction counter to that indicated by the arrow 36. The upper insulator receptacle 47 then pushes the lower insulator receptacle 41 in the same direction, thereby providing a space between the forwardmost surface of the lower insulator receptacle 41 and the lip 46 on the forward end of the barrel 21. The side contact conductor 42 is thus separated from contact with the lip 46 on the barrel 21 as is shown in FIG. 2.

Figure 3:
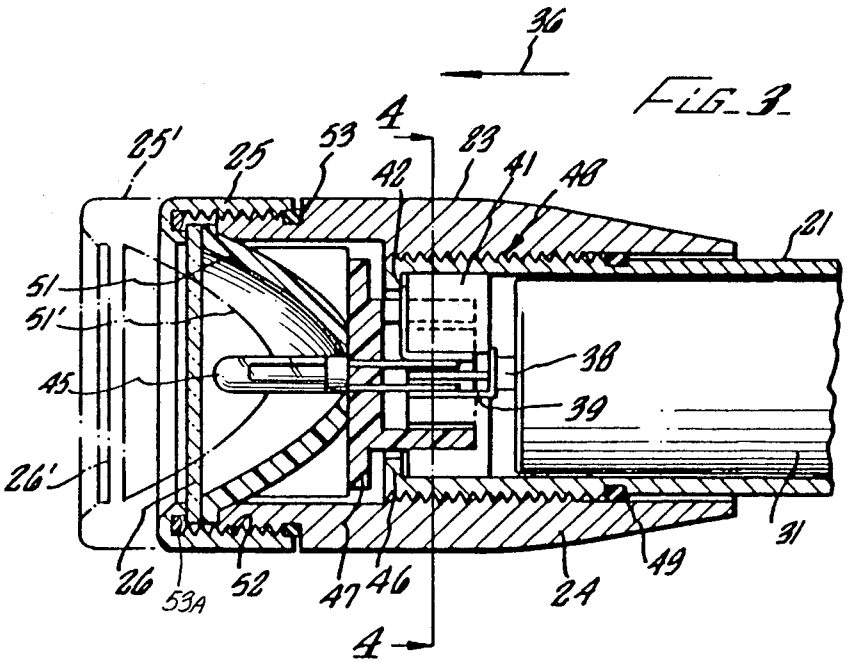
FIG. 3 is a partial cross-sectional view of a forward end of the miniature flashlight of FIG. 1, illustrating, in ghost image, a translation of the forward end of the flashlight.

Referring next to FIG. 3, appropriate rotation of the head 24 about the axis of the barrel 21 causes the head assembly 23 to move in the direction indicated by the arrow 36 through the engagement of the threads 48. Upon reaching the relative positions indicated in FIG. 3 by the solid lines, the head assembly 23 has progressed a sufficient distance in the direction of the arrow 36 such that the reflector 51 has also moved a like distance, enabling the upper insulator receptacle 47 and the lower insulator receptacle 41 to be moved, by the urging of the spring 34 (FIG. 2) translating the batteries 31 in the direction of the arrow 36, to the illustrated position. In this position, the side contact conductor 42 has been brought into contact with the lip 46 on the forward end of the barrel 21, which closes the electrical circuit.

Further rotation of the head assembly 23 so as to cause further translation of the head assembly 23 in the direction indicated by the arrow 36 will result in the head assembly 23 reaching a position indicated by the ghost image of FIG. 3, placing the face cap at the position 25' and the lens at the position indicated by 26', which in turn carries the reflector 51 to a position 51'. During this operation, the upper insulator receptacle 47 remains in a fixed position relative to the barrel 21. Thus the lamp bulb 45 also remains in a fixed position. The shifting of the reflector 51 relative to the lamp bulb 45 during this additional rotation of the head assembly 23 produces a relative shift in the position of the filament of the lamp bulb 45 with respect to a focus of the parabola of the reflector 51, thereby varying the dispersion of the light beam emanating from the lamp bulb 45 through the lens 26.

Figures 4, 5, 6, 7, 8:
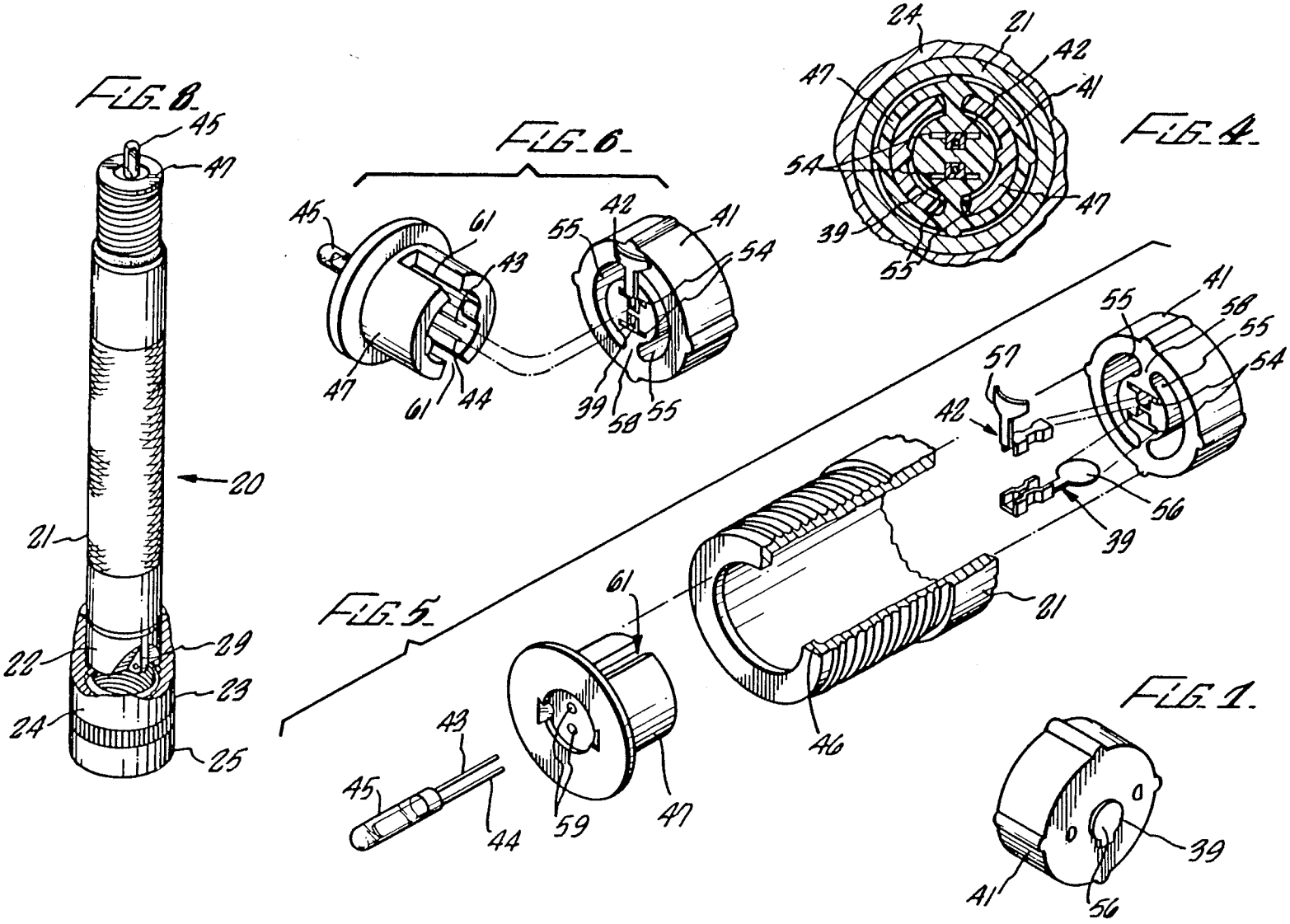
FIG. 4 is a partial cross-sectional view of a lamp bulb holder assembly used in accordance with the FIG. 1 flashlight taken along the plane indicated by 4—4 of FIG. 3.
FIG. 5 is an exploded perspective view illustrating a preferred embodiment of the assembly of the lamp bulb holder assembly with respect to a barrel of the miniature flashlight of FIG. 1.
FIG. 6 is an isolated partial perspective view illustrating the electro mechanical interface between electrical terminals of the lamp bulb and electrical conductors within the lamp bulb holder assembly of FIG. 5.
FIG. 7 presents a perspective view of a rearward surface of part of the lamp bulb holder assembly of FIG. 5, illustrating a one insulator and a battery electrode contact terminal.
FIG. 8 illustrates the FIG. 1 miniature flashlight used as a source of unfocused, substantially spherical illumination.

Referring next to FIG. 4, a partial cross-sectional view illustrates the interface between the lower insulator receptacle 41 and the upper insulator receptacle 47. The lower insulator receptacle 41 has a pair of parallel slots 54 formed therethrough which are enlarged in their center portion to receive the center conductor 39 and the side contact conductor 42, respectively. A pair of arcuate recesses 55 are formed in the lower insulator receptacle 41 and receive matching arcuate extensions of the upper insulator receptacle 47. The lower insulator receptacle 41 is movably contained within the inner diameter of the barrel 21 which is in turn, at the location of the illustrated cross-section, enclosed within the head 24.

Referring next to FIGS. 5 through 7, a preferred procedure for the assembly of the lower insulator receptacle 41, the center conductor 39, the side contact conductor 42, the upper insulator receptacle 47 and the miniature lamp bulb 45 may be described. Placing the lower insulator receptacle 41 in a position such that the arcuate recesses 55 are directionally oriented towards the forward end of the barrel 21 and the lip 46, the center conductor 39 is inserted through one of the slots 54 such that a substantially circular end section 56 extends outwardly from the rear surface of the lower insulator receptacle 41. The circular end section 56 is then bent, as shown in FIG. 7, to be parallel with the rearmost surface of the lower insulator receptacle 41 in a position centered to match the center electrode of the forwardmost one of the batteries 31 of FIG. 2. The side contact conductor 42 is then inserted into the other slot 54 such that a radial projection 57 extends outwardly from the axial center of the lower insulator receptacle 41. It is to be noted that the radial projection 57 aligns with a web 58 between the two arcuate recesses 55.

The lower insulator receptacle 41, with its assembled conductors, is then inserted in the rearward end of the barrel 21 and is slidably translated to a forward position immediately adjacent the lip 46. The upper insulator receptacle 47, containing the lamp bulb 45, is then translated such that the lamp electrodes 43 and 44 align with receiving portions of the side contact conductor 42 and the center conductor 39, respectively. A pair of notches 61, formed in the upper insulator receptacle 47, are thus aligned with the webs 58 of the lower insulator receptacle 41. The upper insulator receptacle 47 is then inserted into the arcuate recesses 55 in the lower insulator receptacle 41 through the forward end of the barrel 21. The lamp electrodes 43 and 44 are then passed through a pair of holes 59 formed through the forward surface of the upper insulator receptacle 47 so that they project outwardly from the rear surface thereof as illustrated in FIG. 6.

Referring again to FIGS. 2 and 3, the electrical circuit of the FIG. 1 miniature flashlight will now be described. Electrical energy is conducted from the rearmost battery 31 through its center contact 37 which is in contact with the case electrode of the forward battery 31. Electrical energy is then conducted from the forward battery 31 through its center electrode 38 to the center contact 39 which is coupled to the lamp electrode 44. After passing through the lamp bulb 45, the electrical energy emerges through the lamp electrode 43 which is coupled to the side contact conductor 42. When the head assembly 23 has been rotated about the threads 48 to the position illustrated in FIG. 2, the side contact conductor 42 does not contact the lip 46 of the barrel 21, thereby resulting in an open electrical circuit. However, when the head assembly 23 has been rotated about the threads 48 to the position illustrated by the solid lines of FIG. 3, the side contact conductor 42 is pressed against the lip 46 by the lower insulator receptacle 41 being urged in the direction of the arrow 36 by the spring 34 of FIG. 2. In this configuration, electrical energy may then flow from the side contact conductor 42 into the lip 46, through the barrel 21 and into the tailcap 22 of FIG. 2. The spring 34 electrically couples the tailcap 22 to the case electrode 35 of the rearmost battery 31. By rotating the head assembly 23 about the threads 48 such that the head assembly 23 moves in a direction counter to that indicated by the arrow 36, the head assembly 23 may be restored to the position illustrated in FIG. 2, thereby opening the electrical circuit and turning off the flashlight.

Referring next to FIG. 8, an additional utilization of the FIG. 1 miniature flashlight 20 in accordance with the present invention is illustrated. By rotating the head assembly 23 about the threads 48 in a direction causing the head assembly 23 to translate relative to the barrel 21 in the direction of the arrow 36 of FIG. 3, the electrical circuit will be closed as previously described, and the lamp bulb 45 will be illuminated. Continued rotation of the head assembly 23 in that direction enables the head assembly 23 to be completely removed from the forward end of the miniature flashlight 20 to provide a substantially spherical, unfocused source of illumination. Additionally by placing the head assembly 23 upon a substantially horizontal surface (not illustrated) such that the face cap 25 rests on the surface, the tailcap 22 of the miniature flashlight 20 may be inserted into the head 24 to hold the barrel 21 in a substantially vertical alignment. Since the reflector 51 (FIG. 2) is located within the head assembly 23, the lamp bulb 45 will omit a substantially spherical illumination, thereby providing a "ambient" light level.

The barrel 21, the tailcap 22, the head 24, and the face cap 25, forming all of the exterior metal surfaces of the miniature flashlight 20 are manufactured from machined high-strength aluminum, which is anodized for corrosion and electrical resistance. All interior electrical contact surfaces are appropriately machined to provide efficient electrical conduction. The reflector 51 is a computer generated parabola which is vacuum aluminum metalized to ensure high precision optics.

Referring to FIGS. 9–20 the single cell flashlight of the present invention will be described. In FIGS. 9–20 components of the single cell flashlight of the present invention which are similar in function to the component described with respect to the FIG. 1 miniature flashlight will be referred to with like reference numerals, except that the reference numerals will have the post script "A" to refer to the component as found in the single cell flashlight of the present invention. The single cell flashlight of the present invention may be constructed in a number of aesthetically pleasing ways, as disclosed for example in co-pending design application, Ser. No. 144,389 filed 1-15-88.

Figure 10:
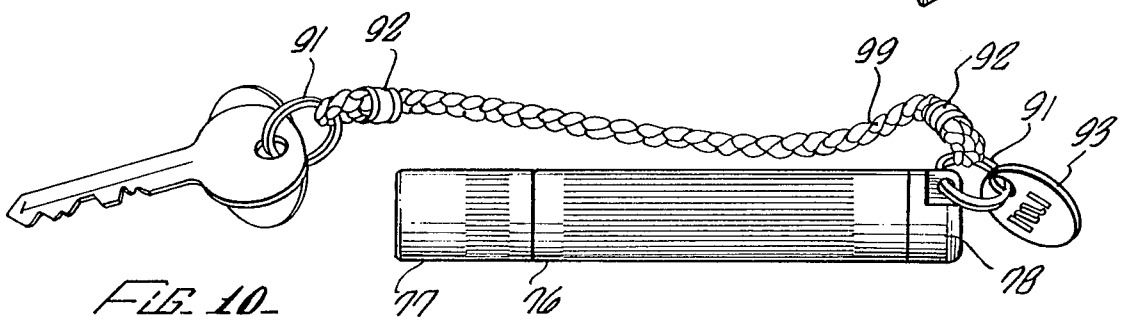
FIG. 10 is a side view of the FIG. 9 flashlight including a lanyard and medallion of the present invention.
Figure 9:
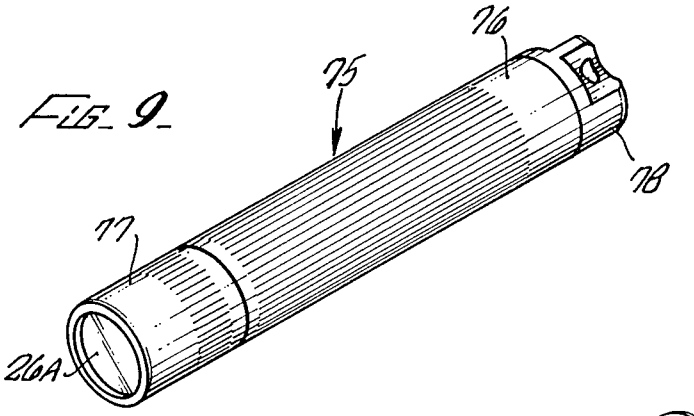
FIG. 9 is a perspective view of a preferred embodiment of the single cell flashlight of the present invention.

FIG. 9 shows a perspective view of a preferred embodiment of the single cell flashlight 75 of the present invention including a barrel 76, a head assembly 77, a lens 26A and a tailcap 78. FIG. 10 is a side view of the FIG. 9 flashlight 75 including a lanyard 99 and a medallion 93 of the present invention. As shown in FIG. 10 the lanyard is attached to the flashlight at the tailcap 78 and is of a length sufficient to extend substantially to the front end and slightly beyond the head assembly 77. The lanyard 99 of the present invention is chosen to be of this length so that when keys are attached to its front end ring 91 light from the flashlight 75 may be directed to both a key and its lock so that during locking or unlocking operation in darkness one hand may be used to hold the flashlight 75 and the lanyard-attached keys while simultaneously directing a beam of light toward the lock. The lanyard length is chosen so that it may cooperate with the flashlight 75 to provide for simultaneous locking or unlocking operation and directing a beam of light onto the key and lock for ease in locking or unlocking operations during darkness. The medallion 93 is provided so that identifying information, such as name and/or address may be engraved thereon.

Figure 11:
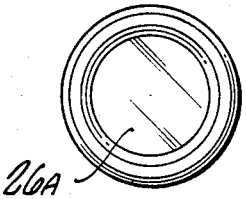
FIG. 11 is a front view of the FIG. 9 flashlight.

FIG. 11 is a front view of the FIG. 9 flashlight showing the lens 26A, which is the same material as and functions as does the lens 26 of the FIG. 1 flashlight.

Figure 12:
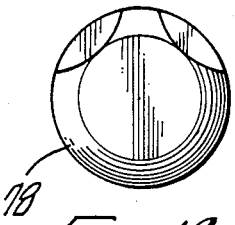
FIG. 12 is a rear view of the FIG. 9 flashlight.

FIG. 12 is a rear view of the FIG. 9A flashlight showing the tailcap 78, as is further described herein.

Figure 13:
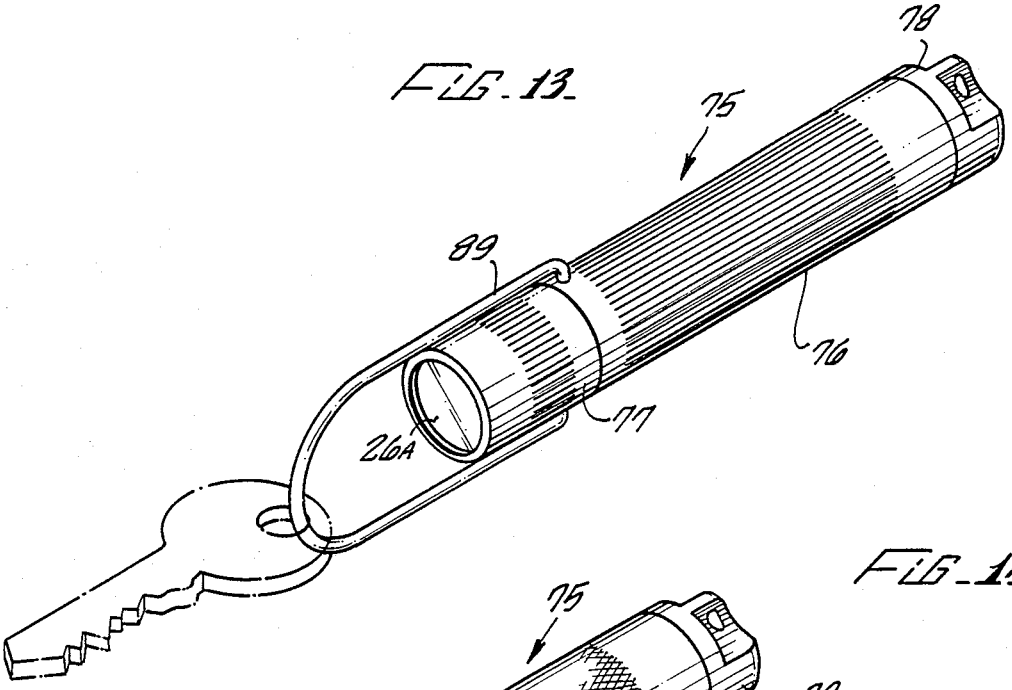
FIG. 13 is a perspective view of another preferred embodiment of the single cell flashlight of the present invention showing a key holder mounted near the head.

FIG. 13 is a perspective view of another preferred embodiment of the single cell flashlight of the present invention and illustrates a key ring holder 89 which may be mounted near the head assembly 77 of the flashlight 75. This key ring holder 89 functions similarly to the lanyard as above described with reference to FIG. 10, except that key ring holder 89 of FIG. 13 is made of another suitable material such as corrosion resistent metal or corrosion resistant plated metal or spring wire. The key ring holder 89 is of a sufficient length and size so that it will hold at least one key, shown in phantom in FIG. 13, and may be swung into position so that the beam of light from the flashlight may be directed not only onto a lock but also upon its key while being held with one hand for easy locking or unlocking operation during darkness. The FIG. 13 embodiment may also have an alternate tailcap design in comparison to the FIG. 9 flashlight such as a solid cap not having a hole for a lanyard or key ring.

Figure 14:
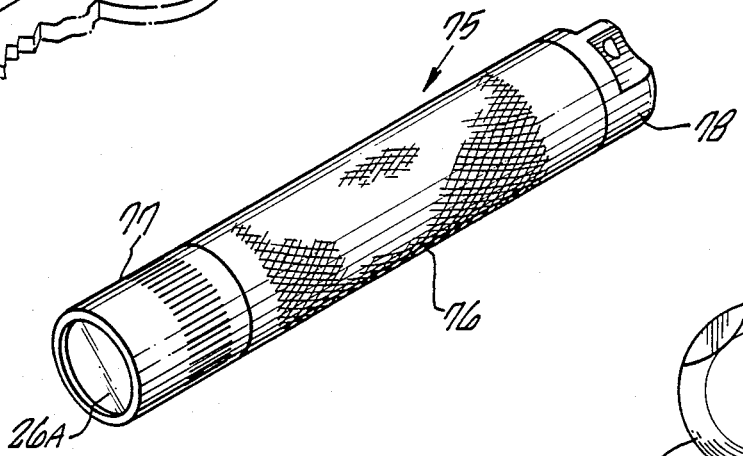
FIG. 14 is a perspective view of the FIG. 9 flashlight having an alternate knurling design.
Figure 15:
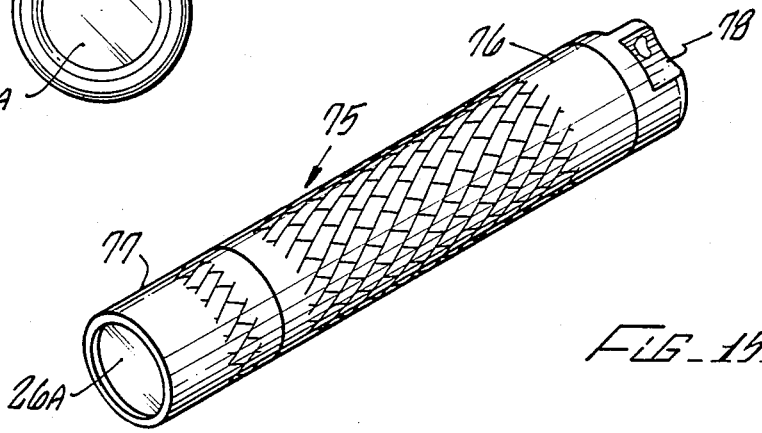
FIG. 15 is a perspective view of the FIG. 9 flashlight having another alternate knurling design.

FIG. 14 shows the FIG. 9 flashlight but with an alternate knurling pattern which is considered to be a alternate aesthetic design and is disclosed in co-pending design application, Ser. No. 144,389 filed 1-15-88. FIG. 15 shows another alternate knurling design in conjunction with the FIG. 9 flashlight and which is also disclosed in co-pending design application Ser. No. 144,389 filed 1-1589.

Although the FIG. 9 and alternate embodiments of the present single cell flashlight invention preferably employ a single "AAA" size battery, the single cell flashlight of the present invention may be scaled to accommodate other sizes of batteries such as a "AAAA" or a special battery size.

The "AAAA" battery is known as a component in the conventional 9-volt battery having clip contacts on its upper end. The conventional 9-volt battery has within its outer casing six small batteries known as the "AAAA" battery, as further described in conjunction with use in flashlights in co-pending patent application, Ser. No. 043,086 filed 4-27-87.

Figure 16:
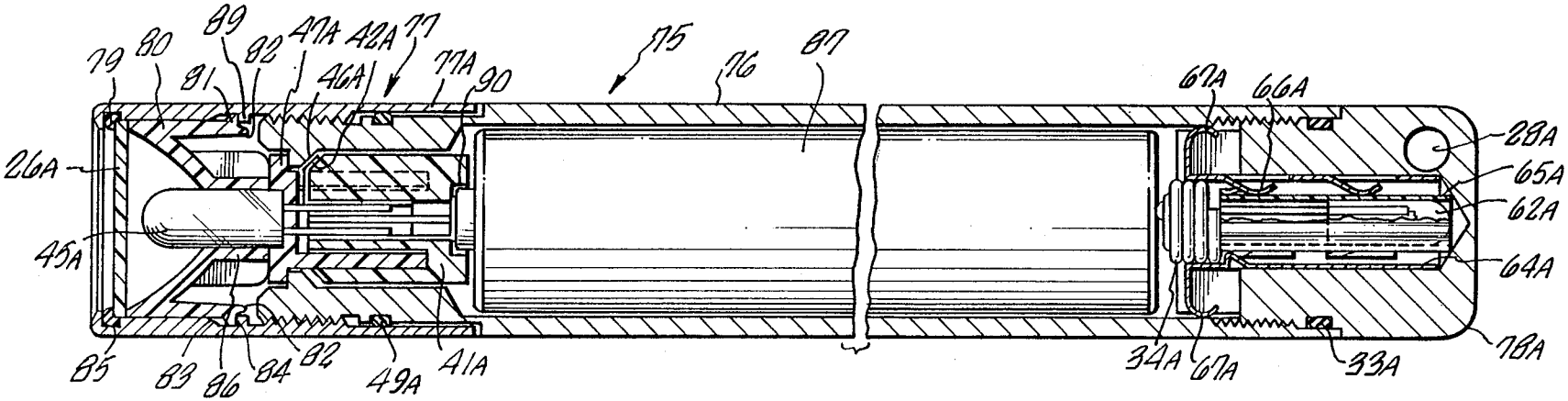
FIG. 16 is a cross-sectional a view of the FIG. 9 flashlight.

Referring to FIG. 16 which is a cross-sectional view of the FIG. 9 flashlight, the single cell flashlight may be described in general terms as having several of the same features as found in the FIG. 1 flashlight. However, as may be seen in FIG. 15 the single cell flashlight 75 has a barrel 76 which is sized to accommodate a single battery of a, preferably, "AAA" or "AAAA" size. The barrel has threads at the head 77 end and a lip 46A which are similar to and function as do the threads and lip 46 as shown with respect to the FIG. 1 flashlight. The lip 46 in the FIG. 1 flashlight is located at the end of the barrel while the lip 46A in the single cell flashlight of the present invention is locate slightly inside the end and has a bottom surface which is at an acute angle to the barrel wall rather than at a right angle as in FIG. 1 flashlight. This slanted wall on the lip 46A cooperates with a complimentary slanted surface on insulator 41A and electrical contact 42A of the FIG. 9 flashlight.

The head assembly 77 includes the head 77A which has internal threads similar to those of the head 23 of the FIG. 1 flashlight. The head assembly 77 of the single cell flashlight does not, however, have a face cap, as does the FIG. 1 flashlight. Rather, as shown in FIG. 16, the forward end of the head 77A has a groove 85 machined into it and into which is placed an O-ring 79. Lens 26A is positioned against the O-ring 79 during assembly by inserting it from the rearward end of the head 77A. The head assembly 77 also includes a computer generated reflector 80 which is substantially parabolic and which is moved during rotation of the head relative to the barrel, and which rotation is similar to that of the FIG. 1 flashlight. A lamp bulb 45A is used and it is identical to the lamp bulb 45 of the FIG. 1 flashlight except that it is modified, in accordance with well known principles, to operate with a single cell source of battery power. The reflector 80 is provided with a plurality of retainer springs 81. The retainer springs 81 function to, upon insertion of the reflector 80 into the head 77, spring radially outward and into recess 83 which has been machined into the inner surface of head 77A. Upon insertion of the reflector 80 into the head 77A having O-ring 79 and lens 26A already inserted, spring inserts 81, upon passing forward of ledge 84 will spring radially outward and into the recess 83. Upon releasing the reflector 80, the O-ring 79, because of its elastic properties, will expand to force the reflector 80 backward so that the spring inserts 81 move up against ledge 84 in the head 77A. Thus, the O-ring 79 provides not only a sealing function at the head 77A lens 26A interface but also provides a spring force, which in conjunction with the ledge 84 and spring inserts 81 maintain the reflector 80 in a fixed longitudinal and radial position relative to the head 77 and lens 26A.

As may be seen the head assembly 77 has an outer diameter which is substantially equal to the outer diameter of the barrel 76, and which is quite different in external appearance from the relatively enlarged diameter head of the FIG. 1 flashlight.

Figure 17:
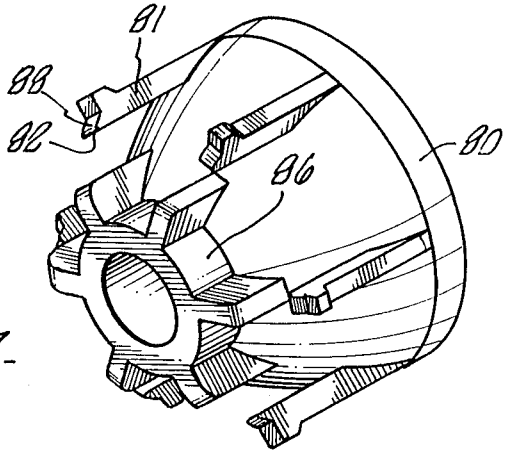
FIG. 17 is a rear perspective view of the reflector of the FIG. 9 flashlight.

Also as may be seen, especially in FIGS. 16 and 17, the reflector 80 of the present single cell flashlight has an extension and radial fins 86 which provide mechanical support for the reflector 80 and for a lower surface which contacts upper insulator 47A to cause movement of the bulb holder assembly upon rotation of the head assembly 77. As shown in FIG. 15 the upper insulator 47A contacts the extension 86 of the reflector 80 whereas in the FIG. 1 flashlight the upper insulator 47A contacts the reflector 51. O-ring 49A is also shown in FIG. 15 and provides a sealing function between the head 77A and barrel 76 in a manner identical to the O-ring 49 as shown in FIG. 2.

With reference to FIG. 16 and FIGS. 2 and 3 the single cell flashlight of the present invention employs a bulb holder assembly including insulators and electrical conductors which are substantially identical in design and function to the bulb holder assembly including insulators and electrical contacts of the FIG. 1 flashlight except for modifications regarding the lip 46A, insulator 41A and contact 42, as previously described, and regarding a feature to prevent operation of the flashlight with the batteries reversed, as will be described.

The bulb holder assembly is further modified so that a small socket 90, sized to accommodate the center contact of the battery is located at the rear of the holder assembly in insulator 41A. With the socket feature incorporated into the bulb holder assembly the flashlight will complete a proper electrical circuit only with the battery inserted in the way with the raised center contact pointed toward the lens 26A.

Referring to FIGS. 16–17, an additional, optional feature which may be incorporated into the reflector 80 of the single cell flashlight invention will be described. The reflector 80 may be constructed so that extensions 82 may be provided to extend rearward from the retainer springs 81. The extensions 82 will have at least one slanted surface 88, as shown best in FIG. 17. The extensions 82 extend rearward from the retainer springs 81 and to or beyond ledge 84 in head 77A. The sizing, angulation and configuration of the extensions 82 are such that a small gap between the surface 88 and the wall 89 of the head 77A is provided. A tool, not illustrated, may then be provided and which may be inserted into the gap between the surface 88 and wall 89 so that upon insertion of the tool in a direction towards the lens 26A and along the surface 88 an inward force will result thus causing the retainer springs 81 to move radially inward to such an extent such that the lens 26A and reflector 80 may be removed from the head 77A for cleaning and/or replacement. The tool may be of a tube shape with an outer diameter sized to fit within the inner diameter of the head 77 and having at one end a slanted edge to form a leading edge which will fit into the gap between wall 89 and surface 88 and which has an angle such that upon insertion of the tool into the gap in the direction towards the lens 26A cooperation of the tool and the reflector will cause sufficient radially inward movement of the retainer springs 81 of the reflector 80 so that the retainer springs 81 are entirely radially inside of recess 83 and subsequent pushing of the lens 26A and/or reflector 80 in a rearward direction will permit removal of the reflector 80 and lens 26A from the head 77A.

FIG. 17 is a rear perspective view of the reflector of the single cell flashlight of the present invention and shows the reflector 80, the retainer springs 81, the retainer spring extensions 82 with slanted surfaces 88 and the reflector extension 86.

Referring to FIG. 16 and FIGS. 17–20 the tailcap and tailcap insert of the single cell flashlight will be described. The single cell flashlight of the present invention may employ a tailcap as shown and described with reference to FIG. 2 or a tailcap not having a key ring hole or one having a different appearance. However, the single cell flashlight of the present invention preferably employs a tailcap with a tailcap insert as described more fully in co-pending utility patent application, Ser. No. 144,389, now abandoned. In this regard FIGS. 19–20 correspond to FIGS. 10, 12 and 14 of co-pending utility patent application, Ser. No. 144,389, now abandoned except that the reference numerals have been appended with a suffix "A" to denote incorporation into the single cell flashlight of the present invention.

Figure 19:
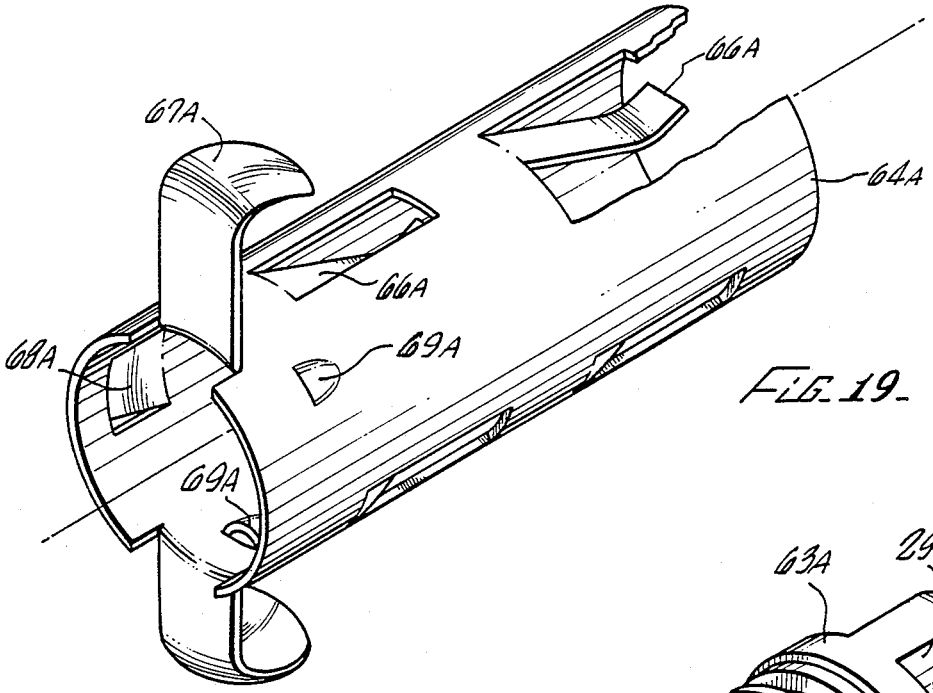
FIG. 19 is an enlarged, perspective view of the tailcap insert of the FIG. 9 flashlight.
Figure 20:
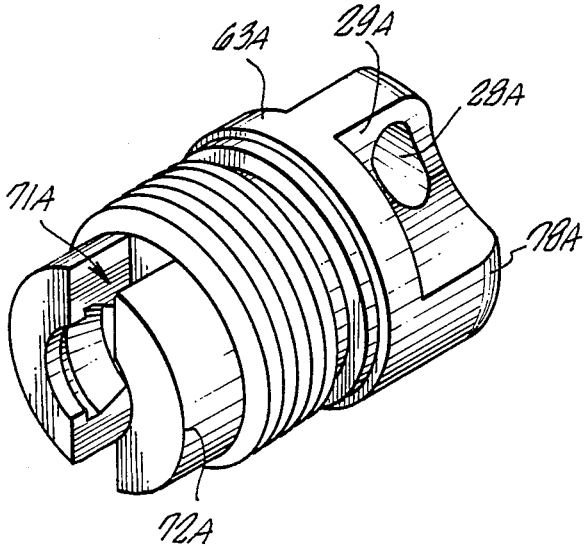
FIG. 20. is an enlarged perspective view of the tailcap of the FIG. 9 flashlight.
Figure 18:
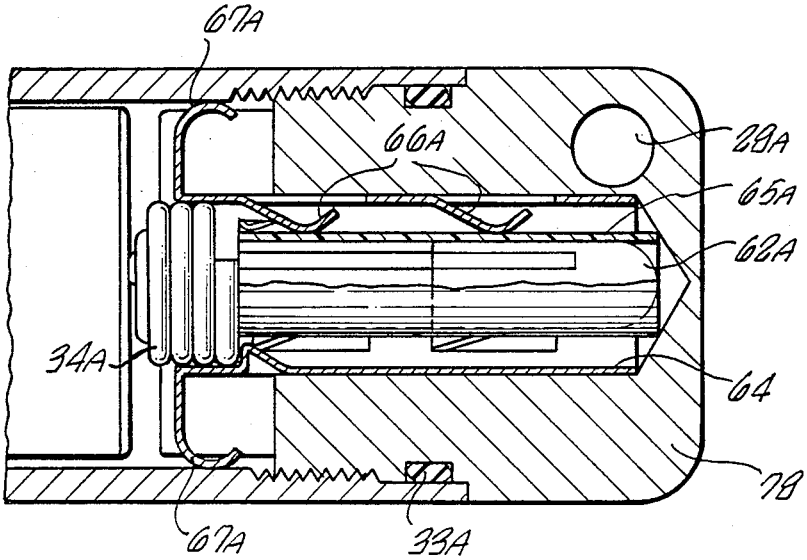
FIG. 18 is an enlarged cross-sectional view of the tailcap end of the FIG. 9 flashlight.

Referring to FIGS. 19–20, the tailcap 78 of the present invention corresponds to alternate tailcap 63 of the co-pending application. The tailcap 78 holds the tailcap insert 64A which includes an optional small plastic protective holder, shown in part at 65A. Spare bulb 62A and/or the holder 65A are secured with the aid of indents 66A which are cut into the sides of the insert 64A. Wings 67A extend radially outward from the central annular portion of the insert 64A and provide for electrical contact with the inner surface of barrel 76 upon insertion of the tailcap 78 into the barrel 76. An O-ring is also shown at 33A to provide for sealing between the tailcap 78 and the barrel 76.

Referring to FIG. 19 in particular, a perspective view of the insert 64A is shown. Snap lock 68A provides for securing insert 64A within tailcap 78. Two of three back stops 69A for preventing spring 34A from slipping back into insert 64A are also shown.

Referring to FIG. 20, a front perspective view of the tailcap 78 is shown. Slot 71A is cut into the front, on threaded portion 72A of the tailcap 78 to provide for orientation and protection of the wings 67A of the insert 64A. The curved or scalloped appearance of the rearwardly extending portion of the tailcap is shown, with a provision for a hole 28A and a tab 29A for attaching a lanyard and/or key ring.

As may be seen from the above description and as shown in FIGS. 19–20, insert 64A provides for a conductive path from the inside of barrel 76 through the wing 67A of the insert 64A, the insert body itself and then to spring 34A which is in contact with insert 64A at least at backstop 69A. As may readily be appreciated, a conductive path is thus formed even though the entire tailcap may be made of insulator material or coated with an insulator material. In conventional designs where the tailcap is coated with an insulator material, additional machining is required to remove this material at region 73 and 74 as shown in FIG. 2. The tailcap insert 64A may be made of any suitable conductive material, such as beryllium copper.

Referring to FIG. 10, the lanyard 99 used in the present single cell flashlight may be made of a nylon braid material and has a ring 91 at either end, with ferrules 92 to secure each end. Preferably, however, one end of the braid material is inserted back into itself and attached to the flashlight as described in co-pending utility patent application, Ser. No. 188,369 filed 4-29-88.

It is also noted that the single cell flashlight of the present invention may be operated to provide unfocused, substantially spherical illumination upon removal of the head assembly 77, just like the FIG. 1 flashlight. However, unlike the FIG. 1 flashlight the single cell flashlight 75 may not be inserted tailcap end first into its inverted head assembly. Rather the single cell flashlight 75 will stand upright on its tailcap alone.

While I have described a preferred embodiment of the herein invention, numerous modifications, alterations, alternate embodiments, and alternate materials may be contemplated by those skilled in the art and may be utilized in accomplishing the present invention. It is envisioned that all such alternate embodiments are considered to be within the scope of the present invention as defined by the appended claims.

I claim:

1. A small flashlight comprising:

a barrel sized to accommodate a single battery;

a head assembly adapted to rotatably engage one end of the barrel and including a lens and a reflector and having an outer diameter substantially equal to the outer diameter of the barrel;

a switching assembly disposed adjacent to said one end of said barrel and including at least one insulator, electrical conductors, and a means for holding a lamp bulb having a filament wherein the switching assembly is movably retained at the one end of the barrel and is axially moveable in response to rotation of the head assembly;

wherein rotation of the head assembly causes relative motion between the filament and the barrel to cause opening and/or closing of at least one electrical contact within the switching assembly; and wherein further rotation of the head assembly causes relative axial motion between the reflector and the filament to provide for changing a dispersion of light during operation of the flashlight.

2. The flashlight of claim 1 wherein the head assembly further includes a head portion and an o-ring; and wherein the head portion further includes a recess into which retailer springs of the reflector are inserted to maintain the reflector in fixed axial relation to the head portion.

3. The flashlight of claim 2 further including the retainer springs being provided with means for removal of the reflector after installation.

4. The flashlight of claim 3 wherein the means for removal includes members extending from the retainer springs and having a first surface extending at an acute angle from the inner surface of the barrel wherein a gap is formed between the inner surface of the head and the first surface of the retainer springs.

5. The flashlight of claim 1 further including a means for holding keys wherein said means is movably attached to the flashlight near the head assembly end of the flashlight.

6. A small flashlight comprising:

a barrel sized to accommodate a single battery;

a head assembly adapted to rotatably engage one end of the barrel and including a lens and a reflector;

a switching assembly disposed adjacent to said one end of said barrel and electrical conductors, and a means for holding a lamp bulb having a filament wherein the switching assembly is movably retained at the one end of the barrel is axially moveable in response to rotation of the head assembly;

wherein rotation of the head assembly causes relative motion between the filament and the barrel to cause opening and/or closing of at least one electrical contact with the switching assembly; and wherein further rotation of the head assembly causes relative axial motion between the reflector and the filament to provide for changing a dispersion of light during operation of the flashlight; and wherein further rotation of the head assembly in a direction away from the barrel will separate the head assembly from the barrel to expose the lamp bulb and to provide for substantially spherical illumination.

7. The flashlight of either of claims 1 or 6 further including a lanyard of a length substantially equal to the length of the flashlight.

8. A small flashlight comprising:

a barel sized to accommodate a single-battery;

a head assembly adapted to rotatably engage one end of the barrel and including a lens and a reflector;

a switching assembly including at least one insulator, electrical conductors, and a means for holding a lamp bulb having a filament wherein the switching assembly is movably retained at the one end of the barrel in response to rotation of the head assembly;

wherein rotation of the head assembly causes relative motion between the filament and the barrel to cause opening and/or closing of at least one electrical contact within the switching assembly; and further including a lanyard of a length substantially equal to the length of the flashlight and attached to the flashlight at an end of the flashlight remote from the head assembly.

9. The flashlight of claim 8 wherein the lanyard consists of a cloth material having at least one ferrule.

10. The flashlight of either of claims 6 or 8 wherein the head assembly is of an outer diameter substantially equal to the outer diameter of the barrel.

11. The flashlight of any of claims 1, 6 or 8 wherein the entire switching assembly is movably retained at the one end of the barrel.

12. A small flashlight comprising:

a barrel sized to accommodate a single-battery;

a head assembly adapted to rotatably engage one end of the barrel and including a lens and a reflector;

a switching assembly including at least one insulator, electrical conductors, and a means for holding a lamp bulb having a filament wherein the switching assembly is movably retained at the one end of the barrel in response to rotation of the head assembly;

wherein rotation of the head assembly causes relative motion between the filament and the barrel to cause opening and/or closing of at least one electrical contact within the switching assembly; and further including a lanyard of a length at least substantially equal to the overall length of the flashlight and attached to the flashlight at an end of the flashlight remote from the head assembly.

13. A small flashlight comprising:

a barrel sized to accommodate a single battery;

a head assembly adapted to rotatably engage one end of the barrel and including a lens and a reflector;

a switching assembly including at least one insulator, electrical conductors, and a means for holding a lamp bulb having a filament wherein the entire switching assembly is movably retained at the one end of the barrel in response to rotation of the head assembly;

wherein rotation of the head assembly causes relative motion between the filament and the barrel to cause opening and/or closing of at least one electrical contact within the switching assembly; and wherein the switching assembly includes means to receive the raised center contact of the battery, to couple the center contact of the battery to the lamp bulb upon insertion of the raised center contact into the means and to prevent electrical coupling of the battery to the lamp bulb upon insertion of the battery into the barrel with the raised center contact facing the tailcap end of the barrel.

14. A small flashlight comprising:

a barrel sized to accommodate a single battery;

a head assembly adapted to rotatably engage one end of the barrel and including a lens and a reflector and having an outer diameter substantially equal to the outer diameter of the barrel;

a switching assembly including at least one insulator, electrical conductors, and a means for holding a lamp bulb having a filament wherein the entire switching assembly is movably retained at the one end of the barrel in response to rotation of the head assembly;

a lanyard of a length substantially equal to the length of the flashlight and made of a cloth material having at least one ferrule;

means for identification of the flashlight owner attached to the flashlight and/or lanyard;

wherein rotation of the head assembly causes relative motion between the filament and the barrel to cause opening and/or closing of at least one electrical contact within the switching assembly, relative axial motion between the reflector and the filament to provide for changing a dispersion of light during operation of the flashlight and further rotation of the head assembly in a direction away from the barrel will separate the head assembly from the barrel to expose the lamp bulb and to provide for substantially spherical illumination.

* * * * *